US005095818A

United States Patent [19]

Bialek

[11] Patent Number: 5,095,818

[45] Date of Patent: Mar. 17, 1992

[54] MEASUREMENT DEVICE IN A ROTARY PRINTING MACHINE

[75] Inventor: Herbert Bialek, Neckargemünd, Fed. Rep. of Germany

[73] Assignee: Heidelberger Druckmaschinen AG, Heidelberg, Fed. Rep. of Germany

[21] Appl. No.: 582,559

[22] Filed: Sep. 14, 1990

[30] Foreign Application Priority Data

Sep. 14, 1989 [DE] Fed. Rep. of Germany ..... 3930782

[51] Int. Cl.[5] ..... B41F 5/06; B41F 13/00

[52] U.S. Cl. ..... 101/183; 101/DIG. 45

[58] Field of Search ..... 101/181, 183, 409, 410, 101/411, 412, DIG. 45; 250/548, 559, 226; 356/416, 429

[56] References Cited

U.S. PATENT DOCUMENTS 4,003,660 1/1977 Christie, Jr. et al. ..... 250/226

FOREIGN PATENT DOCUMENTS 0039533 4/1985 European Pat. Off. .

2659469 9/1977 Fed. Rep. of Germany .

3040455 12/1981 Fed. Rep. of Germany .

3346347 7/1985 Fed. Rep. of Germany .

3703998 12/1987 Fed. Rep. of Germany .

3701721 8/1988 Fed. Rep. of Germany .

*Primary Examiner*—J. Reed Fisher

*Attorney, Agent, or Firm*—Herbert L. Lerner; Laurence A. Greenberg

[57] ABSTRACT

A device for measuring a printing control strip printed on sheet or web material by optical devices located within a printing machine having a plurality of printing units disposed one behind the other, including a measuring cylinder located behind a last one of the printing units and having an outer cylindrical surface portion whereover printed sheet or web material is looped, the optical devices being disposed within the measuring cylinder below a location at which a printing control strip on the material is positionable, as the material is looped over the outer cylindrical surface portion of the measuring cylinder, for measuring the printing control strip.

10 Claims, 3 Drawing Sheets

MEASUREMENT DEVICE IN A ROTARY PRINTING MACHINE

The invention relates to a device for measuring a printing control strip with optical means within a printing machine.

A device for assessing print quality and/or inking has become known heretofore from European Published Non-Prosecuted Application 0 143 744. As described therein, a printed sheet or a printed web moves past a densitometer which is displaceable perpendicularly or vertically to the printed sheet or web, behind or downstream from a last printing unit of a printing machine. At high machine speeds, and accordingly at high paper-sheet or paper-web speeds, the time for registering or determining the measurement values, as the printing control strip moves past is too brief. No reliable measurement value can therefore be established. Although the machine densitometer can, in fact, be displaced in axial direction, it is not possible to adjust it to a printing control strip disposed parallel to the direction of movement of the sheet or the web.

It is accordingly an object of the invention to provide a device of the foregoing general type wherein the measurement of a printing control strip is optimized within the printing machine, even while the machine is running.

It is also an object of the invention to provide a measurement device in a rotary printing machine which overcomes the hereinafore-mentioned disadvantages of the heretofore-known devices of this general type.

With the foregoing and other objects in view there is provided, in accordance with the invention, a device for measuring a printing control strip printed on sheet or web material by optical means located within a printing machine having a plurality of printing units disposed one behind the other, comprising a measuring cylinder located behind a last one of the printing units and having an outer cylindrical surface portion whereover printed sheet or web material is looped, the optical means being disposed within the measuring cylinder below a location at which a printing control strip on the material is positionable as the material is looped over the outer cylindrical surface portion of the measuring cylinder for measuring the printing control strip.

An advantage of the device according to the invention is that the printing control strip can be measured while it remains in the machine without requiring the operator to remove the sheet. Due to the continuous measurement of the printing control strip, it is possible to correct the inking directly, based upon the measurement results which are obtained, thereby considerably improving the inking and avoiding waste-formation.

It is additionally advantageous that a long time is provided for measuring the printing control strip so that a normal measuring-field size is adequate.

The time interval available for measuring the fields on the printing control strips with the densitometer is increased by the fact that the printing control strip and the densitometer together move over about half of a cylinder revolution without any relative velocity to one another. For a machine speed, for example, of 12,000 sheets per hour, with a measuring-cylinder diameter of 270 mm and a cylinder angle of 180 degrees looped by the sheets, the dwell or delay time of a sheet is about 0.15 seconds. This time is measured liberally in order to register a reliable signal.

In accordance with the invention, the measuring device is assembled on a shaft already present in the printing machine, namely in a delivery cylinder, in the case of sheetfed printing machines, and, for example, in a cylinder about which the paper web is looped, in the case of rotary offset machines.

In accordance with another feature of the invention, the optical means comprise light conductors for scanning fields of the printing control strip to be measured and for transmitting signals relating thereto to a densitometer.

Advantages of the latter construction are that signals can be transmitted to evaluation devices outside the printing machine via light conductors. Furthermore, the light conductors require only a relatively small installation space and have a very light weight. In the case of a rotary offset machine, for example, small openings can be provided in the rollers or cylinders for the installation of light conductors.

Another advantage of the foregoing construction of the device according to the invention is that the light conductors can be brought very close to the measurement fields of the printing control strip, which virtually eliminates any falsification of the signals by other influences.

In accordance with a further feature of the invention, the optical means comprise at least one densitometer for measuring fields of the printing control strip.

In accordance with an added feature of the invention, the device includes means for infinitely adjusting the location of the optical means within the measuring cylinder in circumferential direction of the cylinder and for fixing the optical means in position.

In accordance with an additional feature of the invention, the device includes a guide rail extending in axial direction of the measuring cylinder, the optical means being slidably mounted on the guide rail, and a screw drive located adjacent to the guide rail for driving the optical means in the axial direction.

In accordance with yet another feature of the invention, the optical means comprise at least one densitometer for measuring the printing control strip over the entire length thereof as the printing control strip is located at the measuring cylinder.

In accordance with yet a further feature of the invention, the optical means comprise a plurality of densitometers for measuring partial regions of the printing control strip as the printing control strip is located at the measuring cylinder.

In accordance with yet an added feature of the invention, the optical means comprise a plurality of densitometers for measuring individual measurement fields of the printing control strip as the printing control strip is located at the measuring cylinder, the optical means being axially displaceable over one of the measurement fields during each rotation of the measuring cylinder.

In accordance with yet an additional feature of the invention, the printing units have respective plate cylinders of given diameter, and the measuring cylinder has a diameter corresponding to that of the plate cylinders.

In accordance with a concomitant feature of the invention, a sliding guide is carried by the guide rail, the optical means being engaged with the sliding guide so as to be slidable thereon.

Other features which are considered as characteristic for the invention are set forth in the appended claims.

Although the invention is illustrated and described herein as embodied in a measurement device in a rotary printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

Figure 1:
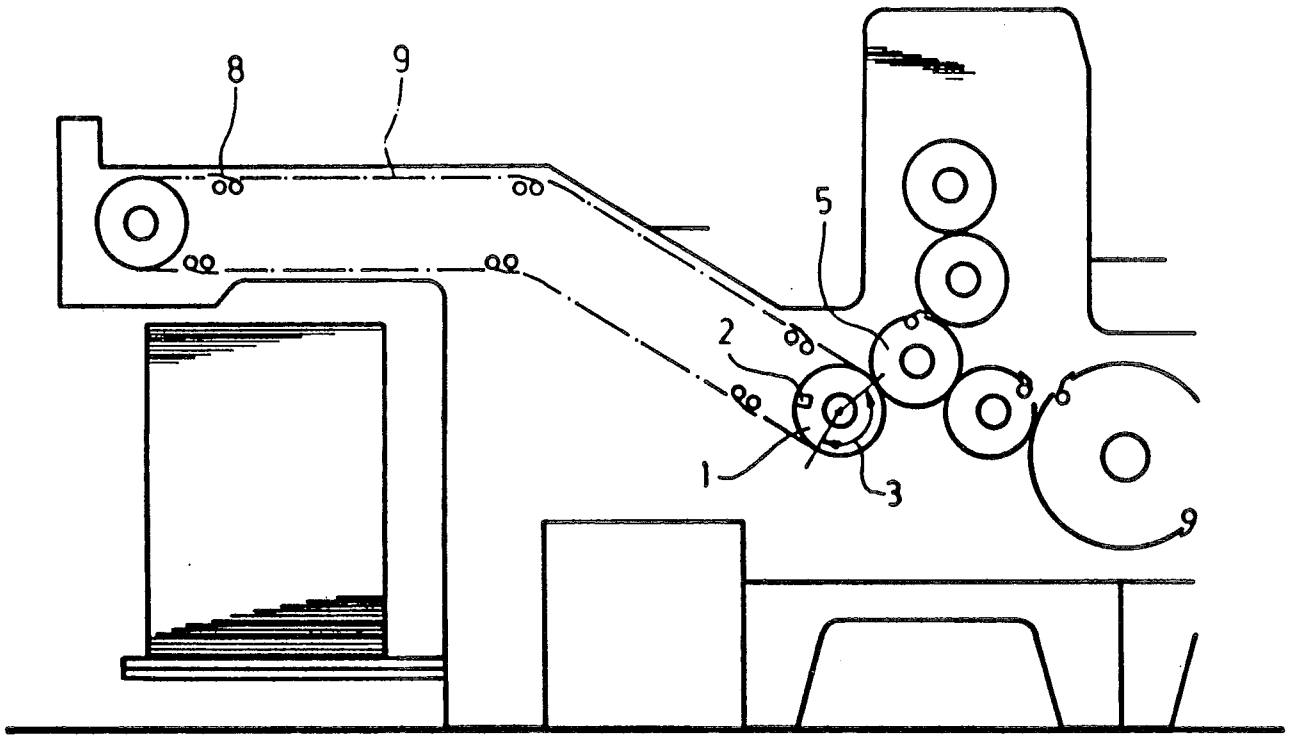
FIG. 1 is a diagrammatic rear elevational view of a sheetfed rotary printing machine incorporating the measurement device according to the invention.
Figure 2:
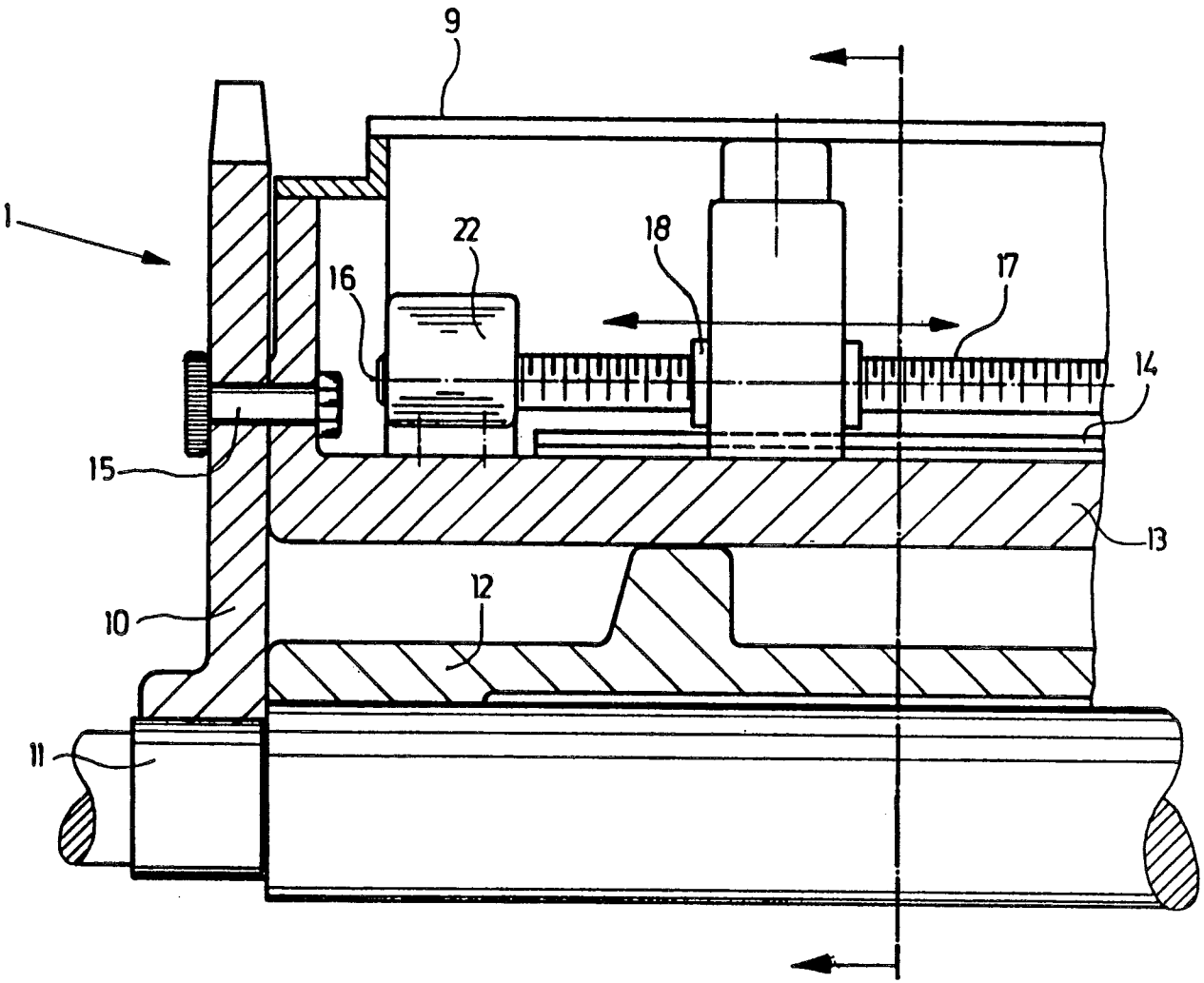
FIG. 2 is a much-enlarged fragmentary cross-sectional view of FIG. 1, namely a half-sectional view of the measurement device according to the invention.
Figure 3:
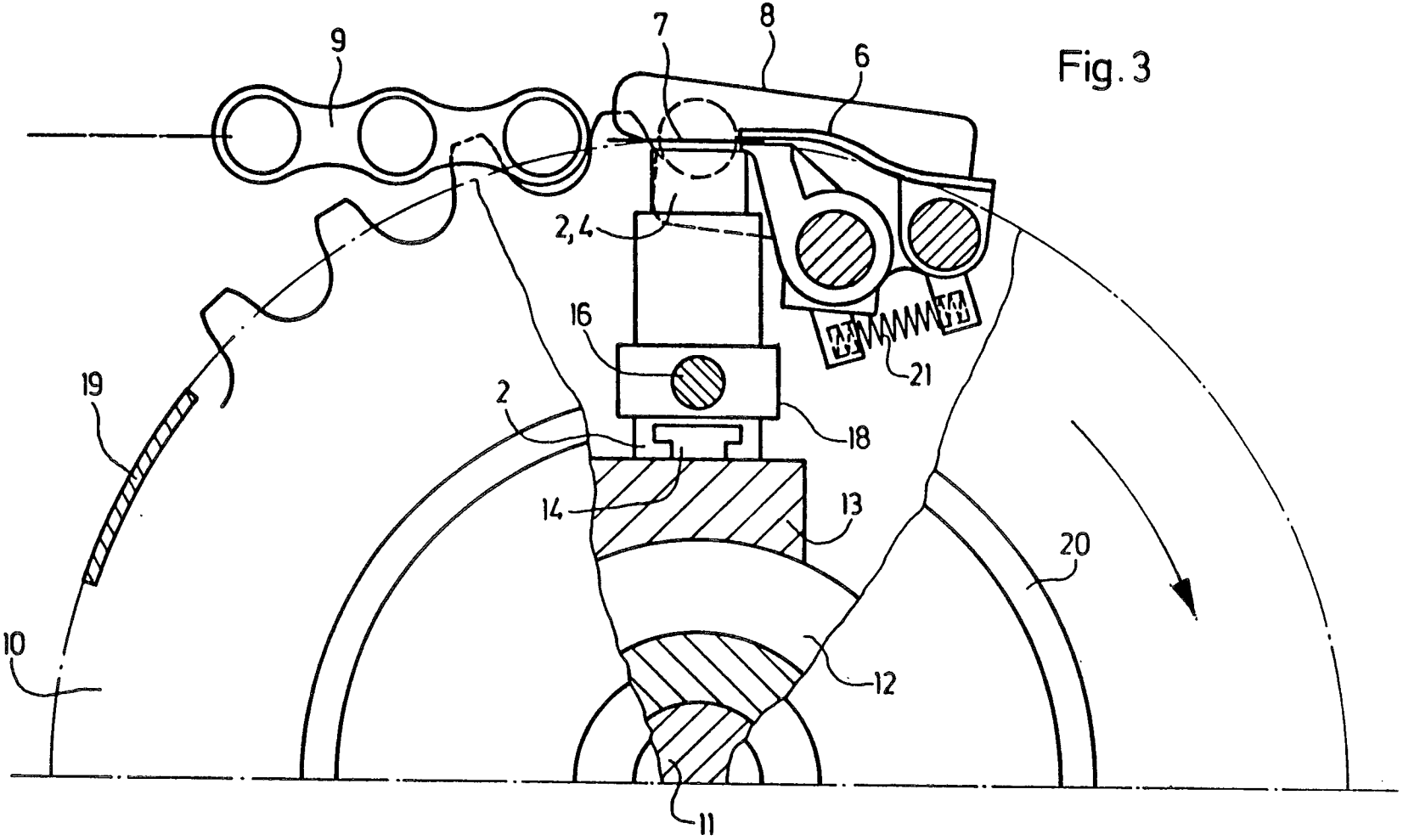
FIG. 3 is a cross-sectional view of FIG. 2, partly broken away to show details thereof.

Referring now to the figures of the drawing, there is seen in FIG. 3 thereof a printed paper sheet 7 which has been transferred to sheet grippers 6 (only one of which is visible in FIG. 3) on a gripper bridge 8. As shown in FIG. 1, the gripper bridge 8 is one of a number thereof which are arranged on a gripper chain 9 which run around chain wheels or sprockets 10 (note FIG. 3, especially). The sheet 7 which is gripped by the respective sheet grippers 6 is slung or looped about a measuring cylinder 1 over a circumferential angle thereof of about 180 degrees in the course of a rotation of the cylinder 1. If a given ink is to be evaluated, the measuring cylinder 1 may be positioned behind the respective printing unit in which that given ink is to be used. A carrier body 12 is mounted on a shaft 11 for the chain sprocket 10 and serves as a support for a guide rail 13 on which a sliding guide 14 is provided. By moving a setscrew 15 (FIG. 2) in a circumferential opening or slot 20 (FIG. 3), optical means 2,4, only one of which is shown in FIGS. 2 and 3, can be shifted to any desired angular position along the periphery of the cylinder 1 and fixed or stopped thereat. By means of a screw drive 16, the optical means 2 or 4, which are disposed adjacent one another and connected to one another by connecting members 17 and supports 18, are able to be reciprocated in axial direction on the guide rail 13 in the sliding guide 14. If a printing control strip of the paper sheet 7 held by the respective sheet grippers 6 extends over optical means 2 or 4, a measurement of the respective measuring fields is triggered. Because no relative movement between the sheet 7 and the measurement cylinder 1 occurs during the measuring process, time is available for the measurement wherein the respective gripper bridge 8, together with the respective sheet grippers 6, is moved around the measuring cylinder 1. The measuring cylinder 1 may also be surrounded by an outer cylindrical shell 19.

Due to the adjustability, in circumferential direction, of the respective optical means 2,4, which may include one or more densitometers, a sheet 7 which is disposed offset by 180 degrees with respect to the respective gripper bridge 8 can also be measured. The measurement of a printing control strip which is printed thereat requires a circumferential adjustment of the optical means 2 or 4 and a fine adjustment of the axial position of the respective optical means 2 or 4.

Through the use of a servomotor with a transmission system 22, the screw drive 16 can be adjusted in axial direction so that the optical means 2 or 4 are displaceable over the entire length of the printing control strip or over a partial region thereof or, for each rotation of the measuring cylinder 1, about individual measuring fields of the respective printing control strip.

I claim:

1. Device for measuring a printing control strip printed on substrate material by optical means located within a printing machine, comprising a plurality of printing units disposed one behind the other whereby a printing control strip is printed on substrate material, a measuring cylinder located behind a last one of the printing units and having an outer cylindrical surface portion over which the printed substrate material is looped, optical means disposed within said measuring cylinder below a location at which the printing control strip on the material is positionable, as the material is looped over the outer cylindrical surface portion of the measuring cylinder, for measuring the printing control strip, and means for moving said optical means and said printing control strip together without relative velocity.

2. Device according to claim 1, wherein said optical means comprise a densitometer, and light conductors for scanning fields of the printing control strip to be measured and for transmitting signals relating thereto to said densitometer.

3. Device according to claim 1, wherein said optical means comprise at least one densitometer for measuring fields of the printing control strip.

4. Device according to claim 1, including means for infinitely adjusting the location of said optical means within said measuring cylinder in circumferential direction of said cylinder and for fixing said optical means in position.

5. Device according to claim 1, including a guide rail extending in axial direction of said measuring cylinder, said optical means being slidably mounted on said guide rail, and a screw drive located adjacent to said guide rail for driving said optical means in said axial direction.

6. Device according to claim 1, wherein said optical means comprise at least one densitometer for measuring said printing control strip over the entire length thereof as said printing control strip is located at said measuring cylinder.

7. Device according to claim 6, wherein said optical means comprise a plurality of densitometers for measuring partial regions of said printing control strip as said printing control strip is located at said measuring cylinder.

8. Device according to claim 6, wherein said optical means comprise a plurality of densitometers for measuring individual measurement fields of said printing control strip as said printing control strip is located at said measuring cylinder, and including means for axially displacing said optical means over one of said measurement fields during each rotation of said measuring cylinder.

9. Device according to claim 1, wherein the printing units have respective plate cylinders of given diameter, and said measuring cylinder has a diameter corresponding to that of the plate cylinders.

10. Device according to claim 5, wherein a sliding guide is carried by said guide rail, said optical means being engaged with said sliding guide so as to be slidable thereon.

* * * * *